United States Patent [19]

Hoskinson et al.

[11] Patent Number: 5,029,788

[45] Date of Patent: Jul. 9, 1991

[54] CLIP-HANGER FOR SUSPENDING ARTICLES FROM WALLS

[75] Inventors: Marlin J. Hoskinson, Philadelphia, Pa.; Eugene M. Lorincz, Cinnaminson, N.J.

[73] Assignee: Moore Push-Pin Company, Wyndmoor, Pa.

[21] Appl. No.: 430,324

[22] Filed: Nov. 2, 1989

Related U.S. Application Data

[63] Continuation-in-part of Ser. No. 321,731, Mar. 10, 1989.

[51] Int. Cl.[5] ..... F16B 45/00

[52] U.S. Cl. ..... 248/218.1; 24/377; 24/711; 248/303; 248/546

[58] Field of Search ..... 248/218.2, 218.1, 218.3, 248/302, 303, 216.1, 216.4, 546; 24/363, 364, 368, 377, 711

[56] References Cited

U.S. PATENT DOCUMENTS

| | | | |
|---|---|---|---|
| 136,662 | 3/1873 | Mason . | |
| D. 197,188 | 12/1963 | Anderson . | |
| 265,986 | 10/1882 | Searing . | |
| 379,759 | 3/1888 | Bradley | 248/218.3 |
| 725,111 | 4/1903 | Merrill | 248/218.1 X |
| 1,252,862 | 1/1918 | Thompson . | |
| 1,334,891 | 3/1920 | Cutting . | |
| 1,340,180 | 5/1920 | O'Brien . | |
| 1,365,354 | 1/1921 | Thayer . | |
| 1,496,282 | 6/1924 | Taylor . | |
| 1,532,566 | 4/1925 | Young . | |
| 1,619,265 | 3/1927 | Middleton . | |
| 1,690,074 | 10/1928 | King . | |
| 1,843,703 | 2/1932 | Boden . | |
| 2,021,730 | 11/1935 | Jones . | |
| 2,104,612 | 1/1938 | Droll | 248/218.1 X |
| 2,148,848 | 2/1939 | Wiley . | |
| 2,228,949 | 1/1941 | Field | 24/711 |
| 2,566,886 | 9/1951 | Hartman . | |
| 2,642,638 | 6/1953 | Larrabee . | |
| 2,767,450 | 10/1956 | Overbaugh . | |
| 3,049,770 | 8/1962 | Markoff-Moghadam . | |
| 3,069,122 | 12/1962 | Babajoff . | |
| 3,083,427 | 4/1963 | Grenon . | |
| 3,349,443 | 10/1967 | Sury . | |
| 3,408,700 | 11/1968 | Chase . | |
| 3,633,253 | 1/1972 | Ellis . | |
| 3,798,710 | 3/1974 | Tinnerman . | |
| 4,181,553 | 1/1980 | Hogg . | |
| 4,217,710 | 8/1980 | Becker . | |
| 4,509,713 | 4/1985 | Hogg | 248/218.3 X |
| 4,597,206 | 7/1986 | Benson . | |
| 4,664,350 | 5/1987 | Dodds et al. . | |
| 4,805,325 | 2/1989 | Cassard . | |
| 4,901,962 | 2/1990 | Greer . | |

FOREIGN PATENT DOCUMENTS

| | | |
|---|---|---|
| 387938 | 7/1908 | France . |

*Primary Examiner*—David L. Talbott

*Attorney, Agent, or Firm*—William H. Eilberg

[57] ABSTRACT

A combination clip and hanger is used to suspend articles from walls, especially fabric-covered soft-core partitions. In one embodiment, the clip-hanger is formed of a single strand of stiff but bendable wire. The wire defines three components of the hanger, namely, a clip, a hook, and a prong. The clip is formed by two or more segments of wire, oriented in a generally longitudinal direction, and located in approximately the same plane. The hook is a generally transverse loop of wire, connecting two of the clip-forming segments, and protruding from the plane of the clip. One or both of the free ends of the wire can be formed into a prong. In another embodiment, the wire is inserted through a generally flat backer. The backer tends to prevent injury due to the prong; it also tends to protect the fabric of the partition. When the clip-hanger of either embodiment is inserted into a fabric-covered partition, the prong separates the fibers of the fabric, generally without piercing the fibers. The prong also does not penetrate far, if at all, into the core of the partition. The clip-hanger grips the fabric over a relatively large area. The clip-hanger can be used to clip articles, such as papers, to the partition, without piercing or otherwise damaging the papers. It can also be used to hang pictures, or similar objects, from a partition, by suspending the picture wire from the hook of the clip-hanger.

5 Claims, 3 Drawing Sheets

CLIP-HANGER FOR SUSPENDING ARTICLES FROM WALLS

CROSS-REFERENCE TO PRIOR APPLICATION

This is a Continuation-in-Part of U.S. patent application Ser. No. 07/321,731, filed Mar. 10, 1989.

BACKGROUND OF THE INVENTION

This invention relates to the field of clips and hangers. The invention is a device for suspending an article from a wall, and especially from a soft-core fabric-covered partition.

Various fasteners, made of a single strand of wire, have been known in the prior art. For example, U.S. Pat. No. 2,767,450 shows a device which combines the functions of a paper clip and a pin in a single-strand piece of wire. U.S. Pat. No. 4,664,350 shows a hanger which is especially designed for use with a soft-wall partition, the hanger also being formed of a single strand of wire. U.S. Pat. No. 1,690,074 discloses an all-wire pin-fastener which combines the piercing function of a pin with the grasping function of a clip. U.S. Pat, No. 1,843,703 shows a pin fastener formed of a single piece of wire. U.S. Pat. No. 2,642,638 shows a clip for sheet material, the clip including sheet-piercing prongs.

Other examples of fasteners formed primarily of a single strand of wire are given in U.S. Pat. Nos. 1,532,566, 1,340,180, 2,021,730, 1,619,265, and 1,252,862.

Soft-core partitions are commonly used to subdivide open spaces in offices. Such partitions are typically covered with a textile fabric or other soft, flexible covering material. Their cores may be formed of a soft plaster or plasterboard, or other similar material. It is thus not recommended to use nails, tacks, or conventional picture hangers with such partitions, because the nails or tacks are likely to damage the core and/or to fracture the fibers of the fabric. When a single nail is used to hang an article, substantially the entire weight of the article is concentrated at the point where the nail pierces the fabric, making it likely that the fabric will be torn, or that the core will be damaged, or both.

One problem with all-wire hangers is that their prongs are hazardous. A prong that is inserted into a fabric may also protrude out of the fabric. There is thus a risk that the prong will prick the user's hand, while the device is being inserted or adjusted.

The present invention solves the problems encountered in hanging or clipping articles from soft-core partitions. The invention provides a structure which minimizes the possibility of damage to the soft core of the partition, and to its covering layer. Also, the embodiment of the invention which includes a backer portion prevents injury to the user due to the sharp prongs. The invention can be used in many applications, in place of conventional picture hangers.

SUMMARY OF THE INVENTION

In one embodiment, the clip-hanger of the present invention is made of a single strand of stiff but bendable wire. The clip-hanger includes three components, namely a clip, a prong, and a hook. The clip is defined by two or more segments of the wire, located generally in the same plane. The hook is formed by a loop of wire which connects two of the segments defining the clip, the loop extending outwardly from the plane of the clip.

The hook extends outwardly by an amount sufficient to hang a picture wire, or similar item, from the hook. At least one of the two free ends of the wire is formed into a textile-type prong.

The clip-hanger may have one or two prongs, depending on whether one or both of the ends of the wire form sharp points. In the case of a single-prong device, the wire defines a generally straight first member, the first member having a free end which forms the prong, a generally straight second member connected to the first member, a hook portion connected to the second member, and a third member connected to the hook. The second and third members are generally parallel to each other, and the first member is oblique to the second and third members. The hook portion extends outwardly from the plane defined by the second and third members. The first, second, and third members are arranged such that they together define a clip.

The first member is the part of the clip-hanger that is inserted into the partition. When the clip-hanger is inserted, the first member need not extend very far into the core of the partition, but it simply grasps the outer layer of fabric. The first member may distort the outer layer of the partition somewhat, especially where the layer is made of a flexible material.

In the two-prong versions, both ends of the wire are formed as prongs, and the wire is still bent so as to define a clip portion and a hook.

In another embodiment, the clip-hanger includes a generally flat backer portion, through which the wire is inserted. When installed on a fabric-covered partition, the backer is located on the exterior surface of the fabric. The backer is sufficiently long that the prong does not extend along the entire length of the backer. Thus, if the prong protrudes out of the fabric, the backer prevents the prong from causing personal injury or property damage. The backer also protects the fabric from wear, due to friction between the object being suspended and the partition.

It is therefore an object of the invention to provide a hanging device which functions both as a clip and as a hanger, and which is especially easy to use with soft-core partitions having a soft outer layer.

It is another object of the invention to provide a clip-hanger which is not likely to damage the core of the partition into which it is inserted, and which is also not likely to damage the outer covering layer.

It is another object to provide a hanger for use with a fabric-covered partition, wherein the hanger grasps the fabric with a spring action similar to that of a paper clip, and wherein the hanger is not likely to fracture the fibers of the fabric covering.

It is another object to provide a hanger for a soft-core partition, wherein the hanger can be made of a single piece of relatively thin wire.

It is another object to provide a hanger as described above, the hanger being usable with existing hardware found on the back of framed pictures.

It is another object to provide a hanger for use with a fabric-covered partition, wherein the hanger spreads the gripping action over a relatively wide area of the fabric, such that the fabric is not likely to tear while supporting an article.

It is another object to provide a clip-hanger which will work with virtually any partition which has an outer layer that can be pierced with a prong.

It is another object to provide a clip-hanger which includes a backer portion, such that the backer tends to prevent the prong of the clip-hanger from causing personal injury or property damage.

It is another object to enhance the safety of sharp-pointed hanging devices.

Other objects and advantages of the invention will be apparent to those skilled in the art, from a reading of the following brief description of the drawings, the detailed description of the invention, and the appended claims.

DETAILED DESCRIPTION OF THE INVENTION

Figure 1:
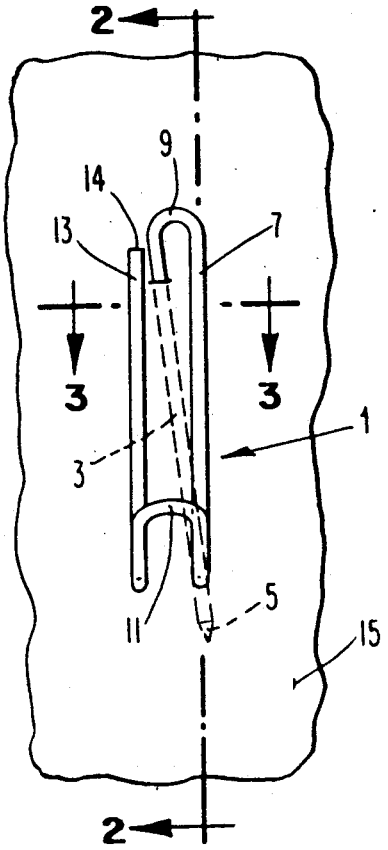
FIG. 1 is a front elevational view of a single-pronged clip-hanger, made according to the present invention, the clip-hanger being shown inserted into a partition.
Figure 2:
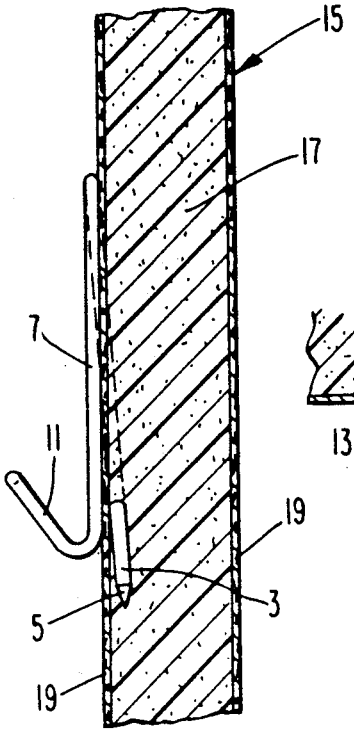
FIG. 2 is a cross-sectional view, taken along the line 2—2 of FIG. 1, showing the partition in cross-section.
Figure 3:
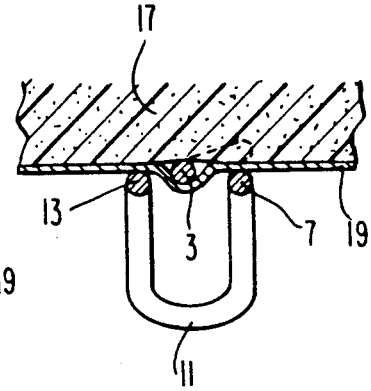
FIG. 3 is a cross-sectional view, taken along the line 3—3 of FIG. 1, showing the distortion of the fabric of the partition by one of the members of the clip-hanger.

FIGS. 1–3 illustrate one version of a first embodiment of the clip-hanger of the present invention. Clip-hanger 1 is formed of a single piece of stiff but bendable wire. The clip-hanger includes a generally straight first member 3, the first member having a free end which is formed into a prong 5. A generally straight second member 7 is connected to the first member, by curved portion 9 of the wire. Second member 7 is connected to hook 11 which is connected to a generally straight third member 13. The hook is formed as a loop of wire, preferably integral with the second and third members. The third member includes the other free end 14 of the piece of wire, but the latter end is not formed into a prong. The second and third members are generally parallel to each other, and are intended to lie substantially flat on the surface of the wall or partition 15 into which the clip-hanger is inserted. The first member is oblique to the second and third members, and is positioned sufficiently close to the second and third members such that the first, second, and third members together define a clip. Before the clip-hanger is inserted, the first, second, and third members may lie almost entirely within the same plane, or, more commonly, the first member will be located slightly behind the plane of the second and third members. When the clip-hanger is inserted, the first member tends to be resiliently displaced from the plane of the second and third members, and the resistance to this displacement causes a clipping effect.

FIG. 2 is a cross-sectional view taken along the line 2—2 of FIG. 1, showing the structure of partition 15 in more detail. Partition 15 includes a core material 17 and an outer layer 19. The core may be made of a relatively soft material such as soft plaster or foamed plastic. The core could also be formed of a harder material such as wood or Masonite, or even steel. The outer layer can be made of fabric, paper, cardboard, or any other material which can be easily pierced by the prong of the clip-hanger.

As shown in FIG. 2, first member 3 is inserted behind outer layer 19, and extends partially into core material 17. In the example shown, it is assumed that the core material is sufficiently soft to be pierced readily by prong 5. If the core material were steel, then the prong would not pierce the core; instead, the first member would be lodged between the inside surface of the outer layer and the core.

FIG. 2 shows how hook 11 extends from the plane of the second and third members. Pictures and other objects can be suspended from hook 11 in the usual manner. The picture wire attached to a conventional framed picture is simply looped over the hook. Thus, the invention can be used with existing picture hanging hardware.

As shown in FIG. 2, second member 7 lies substantially flat on the surface of layer 19. Third member 13 is not visible in FIG. 2, but it also lies substantially flat along the same surface.

The clip-hanger of the present invention not only pierces outer layer 19, but it also grips the outer layer, and possibly part of the core material, due to the clipping effect described above. The clip-hanger grips the outer layer with the spring action of a conventional paper clip. Thus, the gripping force is spread over the relatively wide area of the clip, and is not limited to the point at which the prong pierces the outer layer.

Figure 2A:
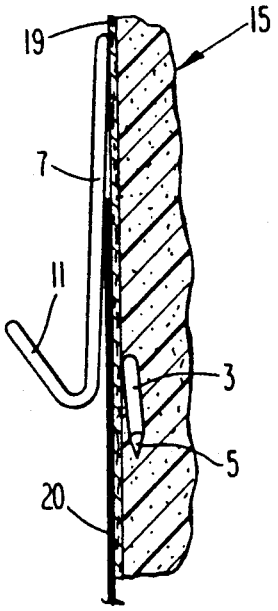
FIG. 2*a* is a cross-sectional view, similar to FIG. 2, showing a piece of paper being held against the partition by the clip-hanger.

FIG. 2*a* shows the use of the clip-hanger of the present invention in holding paper 20 against the partition. Paper 20 can be a single sheet, or it can be several sheets. Note that the paper is not pierced by the prong, but is only held against the partition by the spring action of the clip-hanger. The paper is normally inserted about halfway up the clip-hanger, as shown. If multiple layers of paper are inserted into the clip, or if the single layer is relatively thick, the second and third members are pushed out, away from the surface of the partition.

FIG. 3, a cross-sectional view taken along the line 3—3 of FIG. 1, illustrates the effect of the clip-hanger on an outer layer which is formed of soft fabric. As shown in the figure, outer layer 19 is bent away from core material 17, by first member 3. FIG. 3 also shows that even when the outer layer is soft enough to be distorted by the first member, the first member may still lie somewhat outside of the plane of the second and third members.

While it is possible that the first member will penetrate slightly into the core material of the partition or wall, such penetration is not necessary. More important is the ability of the clip-hanger to pierce the outer layer at one point, and to grip that layer along a relatively wide area, reducing the necessity of deep penetration of the core. Thus, the clip-hanger of the present invention minimizes the possibility of damage to the core material. Moreover, if the prong on the first member is a sharp point which has been ground, polished, and slightly rounded, and if the wire is sufficiently thin, then it is possible to insert the clip-hanger through one or more layers of fabric without cutting even one thread of the fabric. Such slightly rounded sharp prongs have been used in the textile industry, and are shown in some of the above-cited patents.

It is possible to apply a cap, made of plastic or other material, to the clip-hanger, to facilitate insertion, and/or for advertising, identification, or for decorative purposes. The cap could be located over the curved portion 9, and could thus provide a handle with which to insert the clip-hanger. Such a cap is not necessary, however, and the clip-hanger can be easily inserted without the cap.

FIGS. 4–11 illustrate four alternative versions of the embodiment of the clip-hanger shown in FIGS. 1–3. In all of these alternative versions, both ends of the wire are formed into prongs. All of these versions include wire members which function as clips, and all have a hook portion which is similar to that of the clip-hanger shown in FIG. 1.

Figure 4:
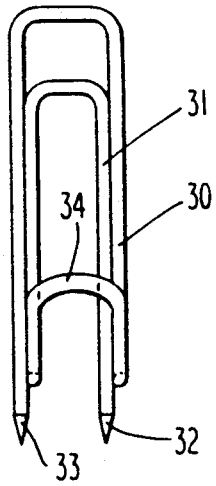
FIG. 4 is a front elevational view of a double-pronged version of the clip-hanger of the present invention.
Figure 5:
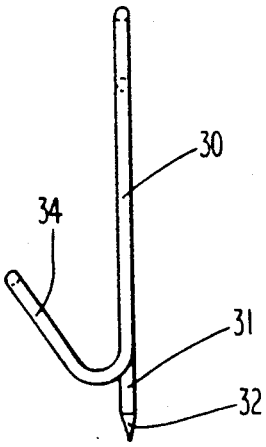
FIG. 5 is a side elevational view of the clip-hanger of FIG. 4.

In the version of FIGS. 4 and 5, a clipping effect is achieved by members 30 and 31, which are nested together as shown. Member 31 terminates in prong 32, and member 30 terminates in prong 33. Hook 34 connects the members 30 and 31. Before the clip-hanger is inserted into the partition, members 30 and 31 lie generally in the same plane. Hook 34 extends from this plane, as is shown in the side elevational view of FIG. 5. The clip-hanger shown in FIGS. 4 and 5 is otherwise similar to that of FIGS. 1–3.

Figure 6:
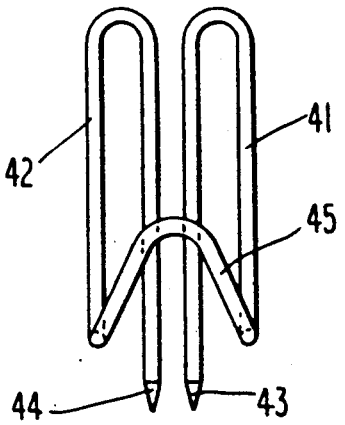
FIG. 6 is a front elevational view of another double-pronged version of the present invention.
Figure 7:
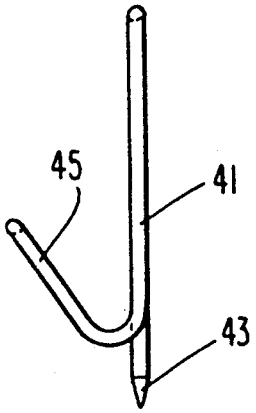
FIG. 7 is a side elevational view of the clip-hanger of FIG. 6.

In the version of FIGS. 6 and 7, members 41 and 42 comprise U-shaped loops which terminate in prongs 43 and 44, respectively, and which are both connected to hook 45. Members 41 and 42 lie substantially in the same plane, before the clip-hanger is used, and achieve the desired clipping effect by the relative bending of the members, and of their constituent segments. Hook 45 extends from the plane of the members 41 and 42, as shown in FIG. 7. The clip-hanger shown in FIGS. 6 and 7 is otherwise similar to that of FIGS. 1–3.

Figure 8:
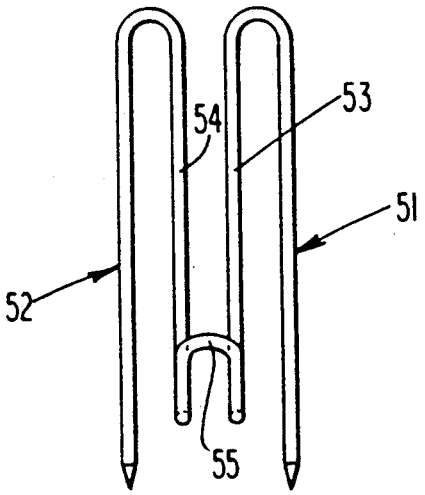
FIG. 8 is a front elevational view of another double-pronged version of the clip-hanger of the present invention.
Figure 9:
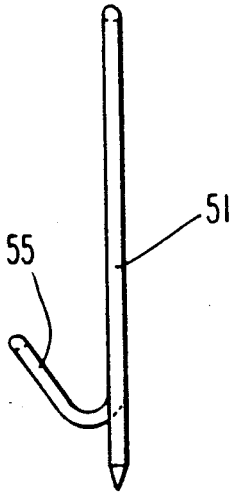
FIG. 9 is a side elevational view of the clip-hanger of FIG. 8.

The version of FIGS. 8 and 9 differs from that of FIGS. 6 and 7, in that the hook 55 is connected to inner segments 53 and 54 of members 51 and 52. Thus, the hook is smaller than that shown in FIG. 6. The hook is otherwise the same as described above, and the members 51 and 52, and their respective constituent wire segments, lie in substantially the same plane and achieve the desired clipping effect. The clip-hanger of FIGS. 8 and 9 is otherwise similar to that of FIGS. 1–3.

Figure 10:
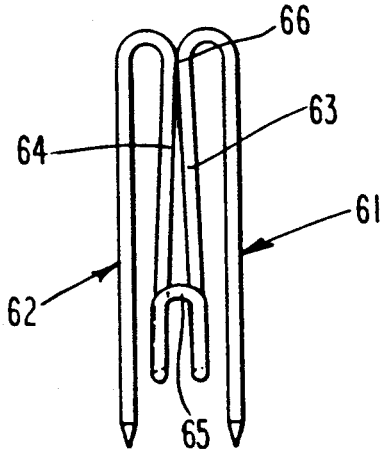
FIG. 10 is a front elevational view of another double-pronged version of the present invention.
Figure 11:
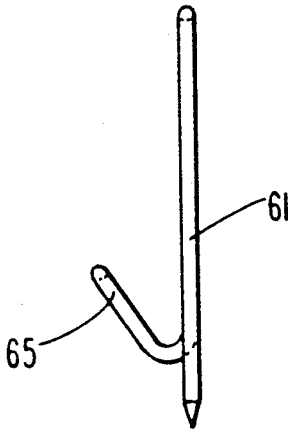
FIG. 11 is a side elevational view of the clip-hanger of FIG. 10.
Figure 13:
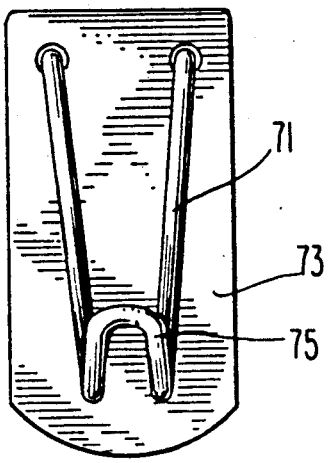
FIG. 13 is a front elevational view of the clip-hanger of FIG. 12.
Figure 12:
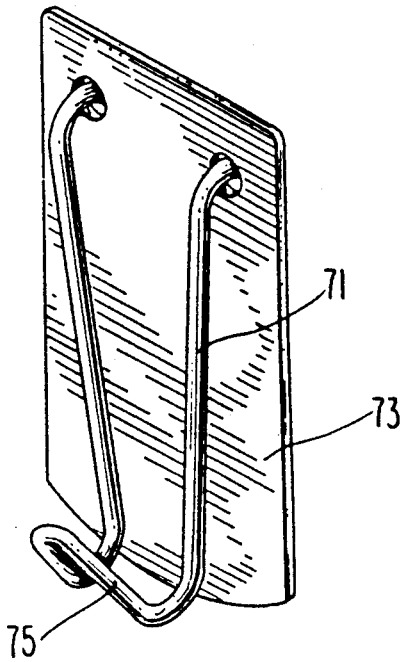
FIG. 12 is a perspective view of another embodiment of the invention, wherein the clip-hanger includes a flat backer portion.

The version of FIGS. 10 and 11 is similar to that of FIGS. 8 and 9, except that inner segments 63 and 64 of members 61 and 62 are not parallel to each other, but instead are angled so that the two inner segments touch, at contact point 66. The clip-hanger of FIGS. 10 and 11 is otherwise similar to that of FIGS. 1–3.

It is preferred that, in all versions, the clip-hanger be formed of a single strand of wire. However, it is possible to make the hanger of several distinct segments, and to join them appropriately. The latter alternative should be considered within the scope of the invention.

Figure 15:
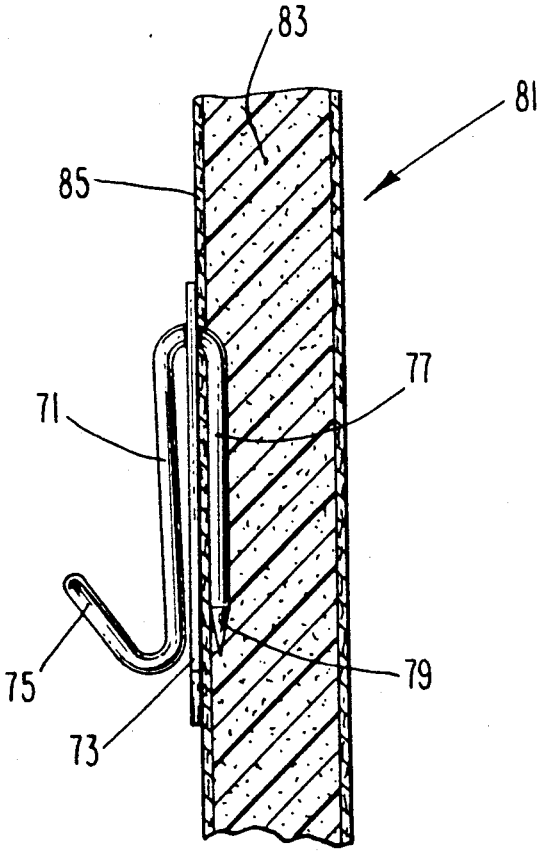
FIG. 15 is a cross-sectional view similar to that of FIG. 2, showing the clip-hanger of FIGS. 12–14 inserted into a partition.
Figure 14:
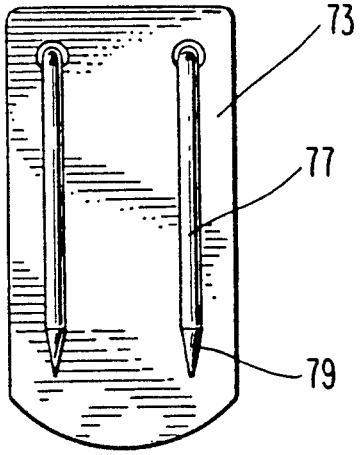
FIG. 14 is a rear elevational view of the clip-hanger of FIG. 12.

FIGS. 12–15 illustrate another embodiment of the present invention. In this embodiment, a wire clip-hanger is combined with a generally flat backer portion. Wire clip-hanger 71 is inserted through backer portion 73. As shown in FIGS. 14 and 15, the prongs of the clip-hanger are inserted through holes in the backer portion. The prongs include prong stems 77 which terminate in sharpened points 79. The clip-hanger includes hook 75, which extends outwardly from the surface of the backer.

As shown in FIG. 14, the prongs are shorter than the length of the backer portion. Since the hook and prongs are on opposite sides of the backer portion, the backer portion isolates the points of the prongs from the hook.

FIG. 15 shows the clip-hanger and backer portion inserted into a fabric-covered partition. Partition 81 includes core 83 and fabric layer 85. Clip-hanger 71 has been inserted through backer portion 73, and the points 79 of the prongs extend into the core. As shown in FIG. 15, backer portion 73 rests on the exterior surface of the partition. Because the backer portion is longer than the prong, the point of the prong cannot emerge from the core and cause injury.

In both embodiments described above, the gripping action of the clip portion of the clip-hanger is spread over a relatively wide area, thereby minimizing the possibility of tearing the outer layer of the partition. This feature contrasts with conventional hanging devices, wherein a single nail or tack is driven into the wall or partition. When substantially all of the weight of the picture or other object is supported by one nail or tack, tearing of the fabric or other soft layer is likely. In the embodiment including the backer portion, the backer portion tends to improve further the distribution of force over the surface of the partition.

While the invention has been described with respect to particular embodiments, it is understood that other variations are possible. One can arrange the first, second, and third members in other configurations which still achieve a clipping effect. The shape of the hook can be varied also. The shape of the backer portion is also not critical, and can be changed. These and other modifications will be apparent to those skilled in the art, and are intended to be included within the spirit and scope of the following claims.

What is claimed is:

1. A two-piece hanging device, comprising a single piece of wire having two ends, the ends being formed into prongs, the wire also defining a pair of rear portions and a pair of front portions, the ends being removably inserted through holes in a generally planar backer portion, the front portions being joined to define a hook which extends outwardly from the plane of the backer portion, the front and rear portions being disposed on opposite sides of the backer portion, the front portions and the rear portions extending along the front and rear surfaces of the backer portion, respectively, and being substantially parallel to said surfaces, the front portions being free of any mechanical connection with said front surface of said backer portion except at said holes, wherein the rear and front portions are resiliently biased towards each other so as to comprise means for non-piercingly grasping as little as one sheet of paper between the front portion and the backer portion.

2. The hanging device of claim 1, wherein the length of the backer portion is greater than the length of the rear and front portions, and wherein the backer portion prevents the prongs from directly touching the front portions.

3. In combination, a two-piece hanging device and a partition, the partition having a core and a covering layer, the hanging device comprising a single piece of wire having two ends, the ends being formed into prongs, the wire also defining a pair of rear portions and a pair of front portions, the ends being removably inserted through holes in a generally planar backer portion, the front portions being joined to define a hook which extends outwardly from the plane of the backer portion, the front and rear portions being disposed on opposite sides of the backer portion, the front portions and the rear portions extending along the front and rear surfaces of the backer portion, respectively, and being substantially parallel to said surfaces, the front portions being free of any mechanical connection with said front surface of said backer portion except at said holes, wherein the rear and front portions are resiliently biased towards each other so as to comprise means for non-piercingly grasping as little as one sheet of paper between the front portion and the backer portion, wherein the backer portion is located between the covering layer of the partition and the front portion of the hanging device.

4. The combination of claim 3, wherein the length of the backer portion is greater than the length of the prongs, and wherein the backer portion prevents the prongs from directly touching the front portions.

5. A hanging device, comprising a single piece of wire, the wire having two ends which are formed as prongs, the prongs being removably inserted through holes in a generally planar backer portion, the portion of the wire that is inserted through the holes being designated as the rear portion, the remaining portion of the wire being designated as the front portion, the front portion of the wire defining a hook extending outwardly from the plane of the the backer portion by an amount sufficient to permit a picture wire or the like to be suspended from the hook, the front and rear portions being disposed on opposite sides of the backer portion, the front portions and the rear portions extending along the front and rear surfaces of the backer portion, respectively, and being substantially parallel to said surfaces, the front portions being free of any mechanical connection with said front surface of said backer portion except at said holes.

* * * * *